US005449324A

United States Patent [19]

Sugawara

[11] Patent Number: 5,449,324

[45] Date of Patent: Sep. 12, 1995

[54] TRICK ARTICLE FOR ILLUSION THAT STICK-LIKE THING IS CUT OFF

[75] Inventor: Shigeru Sugawara, Tokyo, Japan

[73] Assignee: Tenyo Co., Ltd., Tokyo, Japan

[21] Appl. No.: 252,200

[22] Filed: Jun. 1, 1994

[30] Foreign Application Priority Data

Jun. 2, 1993 [JP] Japan ..... 5-029421

[51] Int. Cl.[6] ..... A63J 21/00

[52] U.S. Cl. ..... 472/69; 472/71

[58] Field of Search ..... 472/51, 54, 55, 69, 472/71; 40/427

[56] References Cited

U.S. PATENT DOCUMENTS 1,293,062 2/1919 Erdey ..... 472/71 X
4,557,476 12/1985 Kato ..... 472/71
4,565,364 1/1986 Kondo ..... 472/69

FOREIGN PATENT DOCUMENTS 61-6960 3/1986 Japan .

*Primary Examiner*—Carl D. Friedman
*Assistant Examiner*—Kien T. Nguyen
*Attorney, Agent, or Firm*—Sixbey, Friedman, Leedom & Ferguson; Gerald J. Ferguson, Jr.

[57] ABSTRACT

The trick article giving an illusive cutting of a stick-like thing such as a cigarette or pencil and restoring its initial state, according to the present invention comprising an opaque disk-like rotary member disposed rotatably on a base, transparent auxiliary rotary members movable circumferentially as interlocked with the rotary member, and a housing which encases the rotary member and auxiliary rotary members. The rotary member and auxiliary rotary members have formed therein a main channel and sub channels, respectively, in which the stick-like thing is inserted from an insertion hole formed in the housing. The auxiliary rotary members have fixed therein deceptive stick-like things identical to the front and rear end portions, respectively, of the stick-like thing. When the rotary member is in its first angular position, end portions of the actual stick-like thing are visible through windows formed in the housing. When the rotary member is quickly rotated from the first to the second angular position, the portions of the actual stick-like thing disappear but the deceptive stick-like things fixed in the auxiliary rotary members moved as interlocked with the rotary member will appear in the windows of the housing. The audience will recognize only the existence of the rotary member. Therefore, even if the rotary member is rotated along with the stick-like thing, the portions of the stick-like thing (actually, deceptive stick-like things) will still appear in the windows in the housing. So the audience will have an illusion that the stick-like thing is cut into three pieces.

4 Claims, 9 Drawing Sheets

TRICK ARTICLE FOR ILLUSION THAT STICK-LIKE THING IS CUT OFF

BACKGROUND OF THE INVENTION a) Field of the Invention

The present invention relates to a trick article giving an illusion that a stick-like thing such as a cigarette or pencil is cut off and restoring the cut stick-like thing to its initial complete state, by rotating the article, and which can be an amusement for everybody everywhere.

b) Related Art Statement

Conventional trick articles for such illusion of cutting include large-scale devices the professional magicians use sometimes in magic shows and with which they can play a trick to give the audience an illusion that the body of a living person, especially, a beauty, is cut off with a sword or swords. Also, a small trick article is known as disclosed in the Japanese Examined Patent Publication No. 61-6960, in which a part of a housing containing a stick-like thing such as a cigarette is slid horizontally in a direction to provide an illusion that the cigarette is cut off while it is slid in the opposite direction to restore the cigarette to its initial state. In any of such trick articles, a part of the case housing a person or stick-like thing such as a cigarette is slid to provide an illusion that the object is cut off.

SUMMARY OF THE INVENTION

The present invention has an object to provide a novel trick article of a simple structure, giving an illusion that a stick-like thing such as a cigarette or pencil is cut off and restoring the stick-like thing to its initial state, by rotating the article, and which can be an amusement for everybody everywhere.

The trick article according to the present invention comprises a base member, an opaque housing member fixed to the base member and having an insertion hole through which a stick-like thing such as a pencil or cigarette is inserted; an opaque disk-like rotary member encased in the housing member, disposed rotatably on the base member within a predetermined range of angle between a first and second positions, and having provided as facing the surface of the base member a main channel in which the stick-like thing is passed; and a pair of transparent auxiliary rotary members rotatably on the surface of the base member and between which the rotary member is disposed within the housing member.

The rotary member has provided on the top thereof in a position corresponding to the main channel an indicator which indicates the housing position of the stick-like thing and appeals to the audience that when the rotary member is rotated, the stick-like thing is rotated together.

The housing member has formed nearly in the middle thereof a window in which the indicator of the rotary member is exposed, other two windows are formed in positions symmetrical to each other with respect to the central window, and in addition an insertion hole for the stick-like thing is formed in the circumferential wall of the housing member at a level slightly lower than an extension line through these windows.

The pair of transparent auxiliary rotary members disposed in the housing member have provided as facing the surface of the base member sub channels which receives the front and rear end portions, respectively, of the stick-like thing, beyond the main channel. Further there is provided a means of interlocking the rotary member with the pair of auxiliary rotary members to rotate the pair of auxiliary rotary members within an predetermined range of angle as interlocked with the rotation of the rotary member. In addition, there are fixed adjacently to the sub channels, respectively, of the auxiliary rotary members deceptive stick-like things being a front or rear end portion, identical at least in the appearance to those of the stick-like thing inserted as trick object.

To play a trick for an illusion of cutting of stick-like thing cutting with the article according to the present invention, a stick-like thing is inserted from the insertion hole formed in the circumferential wall of the housing member. The stick-like thing passes through, and received in, the sub channel of one of the auxiliary rotary member, main channel of the rotary member and the sub channel of the other auxiliary rotary member in this order. At this time, the front and rear end portions of the stick-like thing will be visible from outside through the two windows, respectively, formed in the top of the housing member. However, the body portion of the stick-like thing received in the main channel will not be visible from outside.

Next, the rotary member is rotated. The pair of transparent auxiliary rotary members is rotated within the predetermined angular range as interlocked with the rotation of the rotary member. The front and rear end portions of the stick-like thing, having so far been visible from outside through the two windows, will be hidden under the opaque housing member. On the other hand, the deceptive stick-like things corresponding to front and rear end portions, respectively, of the stick-like thing, fixed in the pair of auxiliary rotary members and hidden under the housing member, come to under the two windows and thus they will be visible from outside through the windows. Therefore, the audience will be given an illusion that a stick-like thing is cut off at the boundary between the rotary member and housing member. When the rotary member is rotated reversely, the deceptive stick-like things having so far been visible will disappear but at the same time the front and rear end portions of the stick-like thing having so far been under the housing member will appear in the two windows. Thus, the stick-like thing seems to the audience as if the cut portions thereof were restored to the initial complete state. Besides, when the stick-like thing is taken out of the insertion hole, it will further enhance the illusion that the cut stick-like thing has restored its initial state.

According to the present invention, the trick article may have provided therein a means of uncoupling the rotary member and the pair of auxiliary rotary members from each other when the rotary member is rotated from the first to second position. Thereby, the rotary member can be rotated independently of the pair of auxiliary rotary members, which will give a deep impression that a stick-like thing is actually cut off at the boundary between the rotary member and housing member.

DETAILED DESCRIPTION OF THE PREFERRED EMBODIMENT

These and other objects and advantages will be better understood from the ensuing description made, by way of example, of an embodiment of the trick article for an illusion of cutting according to the present invention with reference to the drawings.

Figure 1:
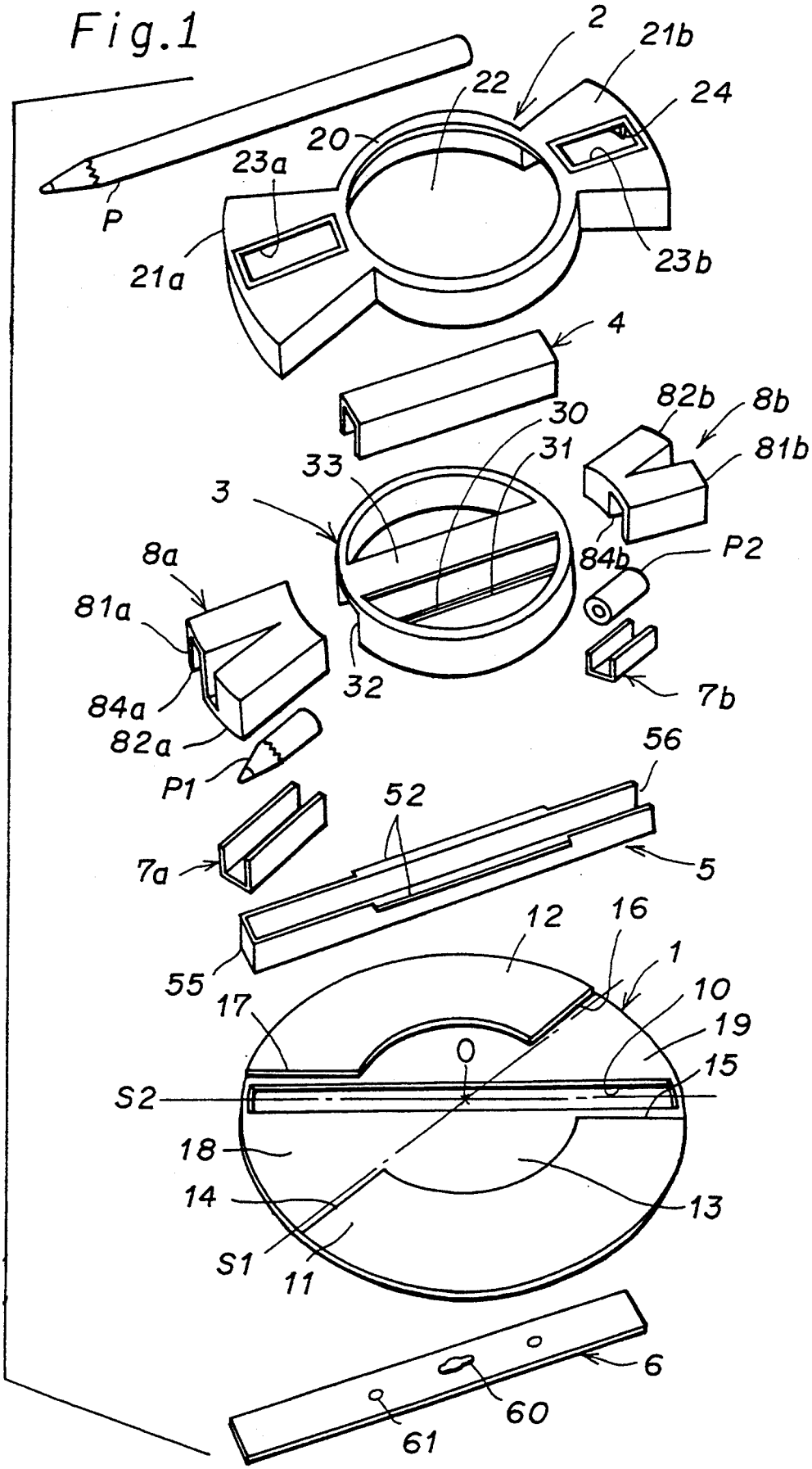
FIG. 1 is a perspective exploded view of a trick article for an illusion of cutting of a stick-like thing according to the present invention.
Figure 2:
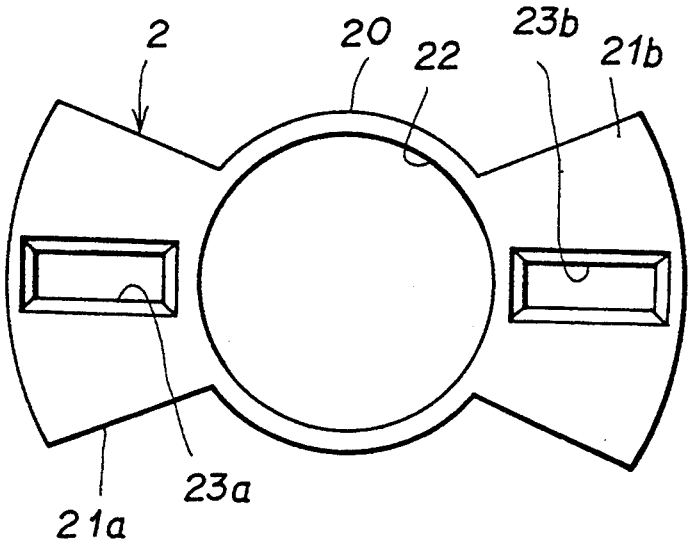
FIG. 2 is a plan view of the housing member.
Figure 3:
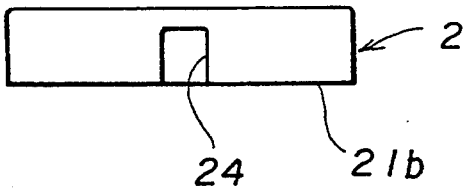
FIG. 3 is a right side elevation of the housing member.
Figure 4:
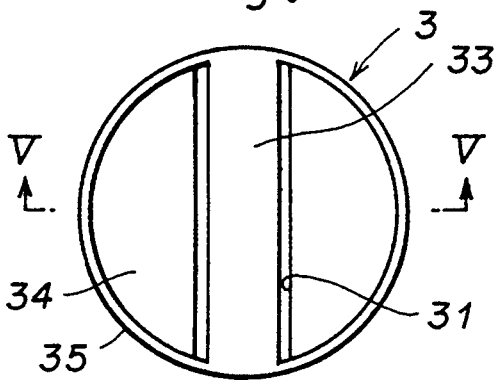
FIG. 4 is a plan view of the rotary member.

In FIG. 1, the symbol P denotes a stick-like thing for use with the trick article according to the present invention. It is a colored pencil in this embodiment.

The reference numeral 1 denotes a base member made of an opaque synthetic resin. The base member I is shaped in the form of a disc in this embodiment. The base member I has formed thereon along the circumferential edge thereof lands 11 and 12 having a nearly same sectorial shape and disposed in opposition to each other on either side of the center O of the base member 1. Thus, the lands 11 and 12 define together a generally circular area 13 on the base member 1 and they have steps 14 and 15 and 16 and 17, respectively. A line connecting the step 14 of the land 11 and the step 16 of the land 12, these steps 14 and 16 being in opposition to each other on either side of the center O, generally corresponds to a first position S1 of a rotary member 3, while a line connecting the step 15 of the land 11 and the step 17 of the land 12, these steps 15 and 17 being in opposition to each other on either side of the center O, generally corresponds to a second position S2 of the rotary member 3. The first and second positions S1 and S2 will be further discussed later.

The base member 1 has an elongated opening 10 formed in a position nearly corresponding to the second position S2 of the rotary member 3. The opening 10 is tapered from the rear to front side of the base member 1 and shaped circular at both ends thereof along the circumferential edge of the base member 1.

The reference numeral 2 denotes a member made of an opaque synthetic resin which houses the rotary member 3 and auxiliary rotary members 8*a* and 8*b* as will be described later. The housing member 2 is composed of a circular portion 20 which is fixed as fitted in the central circular area 13 of the base member 1 and two sectorial portions 21*a* and 21*b* which are fixed as fitted in two sectorial areas 18 and 19 defined between the lands 11 and 12 of the base member 1. The rotary member 3 is placed in the circular portion 20 and the auxiliary rotary members 8*a* and 8*b* are in the sectorial areas 18 and 19, respectively. The circular portion 20 has a circular window or through-hole 22 formed in the top thereof. The sectorial portions 21*a* and 21*b* have formed nearly in the center of the top thereof radially elongated transparent windows 23*a* and 23*b*, respectively. In addition, a hole 24 for insertion of the colored pencil P is formed in the circumferential wall of the sectorial portion 21*b* on a line extended from the two windows 23*a* and 23*b*.

Figure 5:
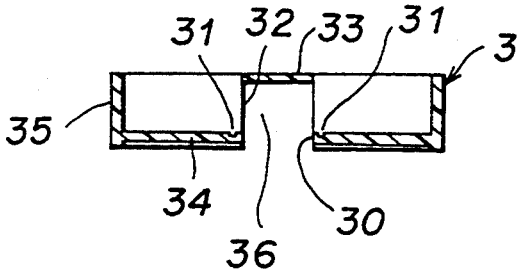
FIG. 5 is a sectional view taken along the line V—V in FIG. 4.
Figure 6:
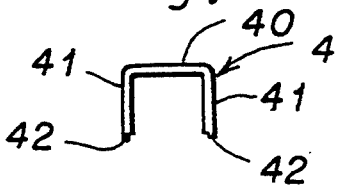
FIG. 6 is a side elevation of the cover member forming the handling lever of the rotary member.

The reference numeral 3 denotes the rotary member having already been referred to in the above. The rotary member 13 is shaped as a disc and made of an opaque synthetic resin. The rotary member 3 is so put in the circular portion 20 of the housing member 2 as to be rotatable in the circular area 13 of the base member 1. As shown in FIG. 5, the rotary member 3 has a bottom wall 34 made of two circular portions separated from each other by an elongated rectangular cut 30 formed diametrically of the rotary member 3. The rotary member 3 includes also a circumferential wall 35. The circumferential wall 35 has rectangular openings 32 formed in portions thereof corresponding to the opposite ends, respectively, of the cut 30. The upper edges of the circumferential wall 35, corresponding to the openings 32, respectively, are coupled to each other by means of an elongated rectangular bridge member 33 formed as diametrically extended. The clearance between the bottom wall 34 of the rotary member 3 and the bridge member 33 is closed by a cover member 4 having a nearly C-shaped section as shown in FIGS. 1 and 6. The cover member 4 is made of an opaque synthetic resin and consists of a rectangular fiat plate 40 and right and left side plates 41. It is open at the bottom and both ends thereof. Both the ends of the fiat plate 40 are formed to have a curvature generally equal to or a little smaller than that of the circular window 22 of the housing member 2. In addition, the cover member 4 has engagement projections 42 provided at the bottom ends, respectively, of the right and left side plates 41. The cover member 4 is fitted on the bridge member 33 of the rotary member 3, and at this time, the engagement projections 42 are engaged in engagement recesses 31, respectively, formed in the bottom wall 34 of the rotary member 3 adjacently to the rectangular cut 30. The fight and left side plates 41 of the cover member 4 closes the clearance between the bottom wall 34 and bridge member 33 of the rotary member 3 to define a main channel 36 in which the body of colored pencil P is inserted. Note that the bottom of the bottom wall 34 of the rotary member 3 is a little apart from the bottom of the circumferential wall 35 so that the rotary member 3 can be rotated on the base member 1 with a reduced frictional resistance. In addition, the cover member 4 indicates the position of the colored pencil P inserted in the main channel 36 and also serves as a lever for manual rotation of the rotary member 3.

Figure 7:
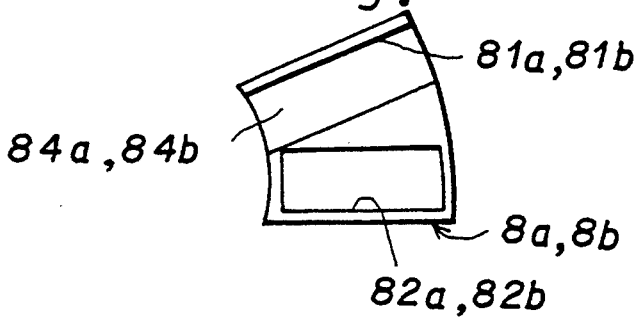
FIG. 7 is a plan view of the auxiliary rotary member; of the rotary member.
Figure 8:
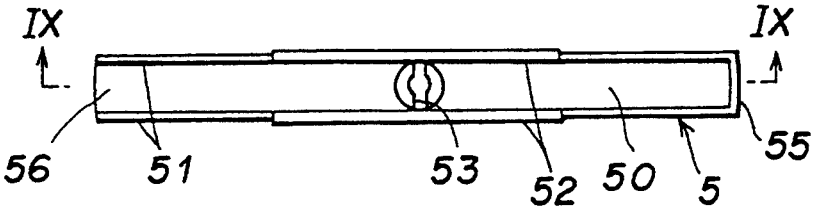
FIG. 8 is a plan view of the receiving member.
Figure 9:
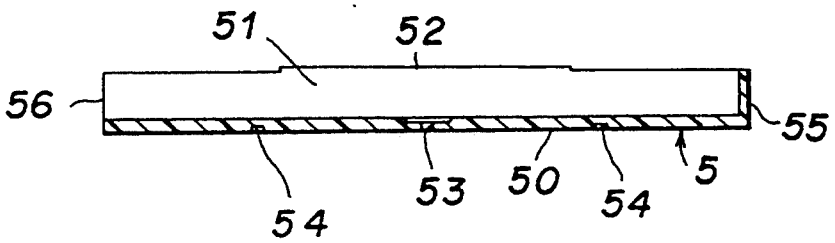
FIG. 9 is a sectional view taken along the line IX—IX in FIG. 8.
Figure 10:
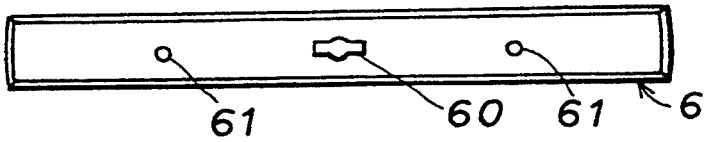
FIG. 10 is a plan view of the coupling member.
Figure 11:
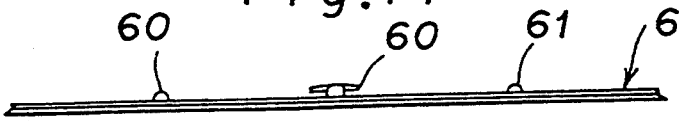
FIG. 11 is a right side elevation of the coupling member.

The auxiliary rotary members 8*a* and 8*b* in pair are made of a transparent synthetic resin and formed generally sectorial. They are so housed in the sectorial portions 21*a* and 21*b*, respectively, of the housing member 2 as to be rotatable circumferentially in the sectorial areas 18 and 19 of the base member 4. These auxiliary rotary members 8*a* and 8*b* are adapted to be movable through a predetermined range of angle as the rotary member 3 is rotated, which will be further described later. More particularly, the central angle of the sector forming each of the auxiliary rotary members 8*a* and 8*b* is the difference between the central angle of each of the sectorial portions 21*a* and 21*b* of the housing member 2 and an angle defined between the first position S1 and second position S2 of the rotary member 2. As shown in FIG. 7, the auxiliary rotary member 8*a* consists of a first portion 81*a* having radially formed therein a sub channel 84*a* in which the sharpened front end portion of the colored pencil P is put and a second portion 82*a* formed contiguous to the first portion 81*a* in which a deceptive colored pencil P1 (namely, a dummy pencil) identical to the sharpened or front end portion of the pencil P is housed as radially directed. On the other hand, the auxiliary rotary member 8*b* consists of a first portion 81*b* having radially formed therein a sub channel 84*b* in which the rear end portion of the colored pencil P is put and a second portion 82*b* formed contiguous to the first portion 81*b* in which another deceptive colored pencil P2 (namely, a dummy pencil) identical to the rear end portions of the pencil P is housed as also radially directed. The deceptive colored pencils P1 and P2 are made by cutting a colored pencil identical to the colored pencil P. The second portions 82*a* and 82*b* have fixed therein the deceptive colored pencils P1 and P2, respectively, as shown in FIG. 1 and are closed with covers 7*a* and 7*b*, respectively, made of a same opaque synthetic resin as the material of a receiving member 5 which will be described later.

The geometrical relation between the rotary member 3 and auxiliary rotary members 8*a* and 8*b* will be described herebelow. In the first position S1 of the rotary member 3, the second portions 82*a* and 82*b* of the auxiliary rotary members 8*a* and 8*b*, respectively, are in contact with the steps 14 and 16, respectively, formed on the base member 1. In the second position S2 of the rotary member 3, the first portions 81*a* and 81*b* of the auxiliary rotary members 8*a* and 8*b*, respectively, are in contact with the steps 15 and 17, respectively, formed on the base member 1. In any of these positions S1 and S2, the rotary member 3 has the main channel 36 generally aligned with the sub channels 84*a* and 84*b* of the auxiliary rotary members 8*a* and 8*b*, respectively. More particularly, when the rotary member 3 is rotated to the first position S1, the first portions 84*a* and 84*b*, that is, the sub channels 84*a* and 84*b*, of the auxiliary rotary members 8*a* and 8*b*, respectively, come to positions corresponding to the elongated windows 23*a* and 23*b*, respectively, in the housing member 2. In the second position S2 of the rotary member 3, the second portions 82*a* and 82*b* housing therein the deceptive colored pencils P1 and P2 take positions corresponding to the windows 23*a* and 3*b*, respectively.

To interlock the above-mentioned pair of auxiliary rotary members 8*a* and 8*b* with the rotation of the rotary member 3, a means 5 is provided which is designed in the form of a receiving member which is to be fitted in the main channel 36 and sub channels 48*a* and 48*b* to receive the colored pencil P. This pencil receiving member 5 is made of an opaque synthetic resin and consists of a bottom plate 50 and fight and left side plates 51, all formed generally rectangular, and an end plate 55. The curvature of both the ends of the bottom plate 50 is slightly smaller than the diameter of the base member 1. The fight and left side plates 51 have formed integrally therewith along the middle upper edge portions thereof engagement projections 51 extending out almost horizontally.

The pencil receiving member 5 can be removably fitted in the main channel 36 of the rotary member 3 and the sub channels 84*a* and 84*b* of the auxiliary rotary members 8*a* and 8*b*, respectively. Fitted in the channels 36, 84*a* and 84*b*, it is disposed in the housing member 2. The pencil receiving member 5 is open at the end thereof (indicated at 56) opposite to the end plate 55. When in the housing member 2, the open end 56 of the pencil receiving member 5 is inside the sectorial portion 21*b* of the housing member 2. The sectorial portion 21*b* has the pencil insertion hole 24 formed in the circumferential wall thereof as previously mentioned. In this geometry, the colored pencil P can be inserted into or taken out of the receiving member 5 through the insertion hole 24.

The reference numeral 6 denotes a closing member formed from a rectangular plate made of an opaque synthetic resin and which covers the elongated opening 10 in the base member I from the rear side thereof. When the rotary member 3 is in the first position S1 thereof or in the intermediate position between the first and second positions S1 and S2 thereof, the pencil receiving member 5 is rotatably coupled to the closing member 6. On the other hand, when the rotary member 3 is in the second position S2 thereof, the pencil receiving member 5 is held coupled to the closing member 6 but falls down due to its own weight through the elongated opening 10 and thus protrudes to the rear side of the base member 1, so that the rotary member 3 and pair of auxiliary rotary members 8*a* and 8*b* will be unlocked from each other.

More specifically, the pencil receiving member 5 has formed in the middle of the bottom plate 50 thereof an engagement hole 53 of which the central portion is formed circular while both the end portions are formed rectangular, and also it has provided on the rear side of the bottom plate 50 a pair of positioning small-circular concavities 54 formed in positions symmetrical with respect to the engagement hole 53. The closing plate or closing member 6 is formed a size larger than the bottom plate 50 of the pencil receiving member 5 and has the form of a rectangle nearly equal in size to the elongated opening 10 in the base member 1. The curvature of opposite ends of the closing member 6 is a little smaller than the diameter of the base member 1. The circumference of the closing member 6 is tapered from the front to rear side of the closing member 6 so that it can precisely fit the tapered circumference of the elongated opening 10 from the rear side of the base member 1. When the tapered circumference of the closing member 6 is fitted to that of the opening 10, the rear surface of the closing member 6 is flush with that of the base member 1. In addition, the closing member 6 has provided in the middle of the front side thereof a hook and cylinder assembly 60 formed integrally therewith and of which the hook portion is directed longitudinally of the closing member 6. The hook assembly 60 is so shaped as to be engageable in the engagement hole 53 in the bottom plate 50 of the pencil receiving member 5. For coupling the pencil receiving member 5 to the closing member 6, the pencil receiving member 5 is held perpendicularly across the closing member 6 fitted in the opening 10 of the base member 5, then the hook assembly 60 of the closing member 6 is engaged into the engagement hole 53 in the bottom plate 50 of the pencil receiving member 5 and thereafter the pencil receiving member 5 is rotated. Furthermore, the closing member 6 has formed on the front side thereof a pair of small-circular convexities 61 corresponding to the concavities 54 in the bottom plate 50 of the pencil receiving member 5. When the convexities 61 are engaged in the concavities 54, respectively, the closing member 6 will set in place with respect to the pencil receiving member 5. When the pencil receiving member 5 is rotated along with the rotary member 3 to the second position S1, the pencil receiving member 5 and closing member 6 will fall down together through the opening 10 and thus protrude to the rear side of the base member 1.

Therefore, as the rotary member 3 is rotated from the first position S1 toward the second position S2, the pencil receiving member 5 will be rotated along with the rotary member 3 and auxiliary rotary members **8*a* and 8*b* while being in contact with the circular area 13 and sectorial areas 18 and 19 of the base member 1. When the rotary member 3 takes the second position S2, the pencil receiving member 5 will fall down due to its own weight through the elongated opening 10 in the base member 1. Thus the pencil receiving member 5 will be dissociated from the main channel 36 of the rotary member 3 and the sub channels 84*a* and 84*b* of the auxiliary rotary members 8*a* and 8*b***, respectively.

As having been described in the foregoing, when the rotary member 3 is in the first position S1, the main channel 36 thereof is flush with the sub channels **84*a* and 84*b* of the auxiliary rotary members 8*a* and 8*b*, respectively. The first portions 81*a* and 81*b* of the transparent auxiliary rotary members 8*a* and 8*b*, respectively, take positions generally corresponding to the windows 23*a* and 23*b*, respectively, of the opaque housing member 2 while the second portions 82*a* and 82*b* housing the deceptive colored pencils P1 and P2, respectively, are covered with the sectorial portions 21*a* and 21*b*, respectively, of the housing member 2. So the second portions 82*a* and 82*b* are not visible from outside. When the rotary member 3 has been rotated from the first position S1 to the second position S2, the first portions 81*a* and 81*b* of the auxiliary rotary members 8*a* and 8*b*, respectively, are covered with the sectorial positions 21*a* and 21*b*, respectively, of the housing member 1 and thus they are not visible from outside. However, since the second portions 82*a* and 82*b* housing the deceptive colored pencils P1 and P2, respectively, take positions generally corresponding to the windows 23*a* and 23*b*, respectively, of the housing member 2**, so they are visible from outside.

Figure 12:
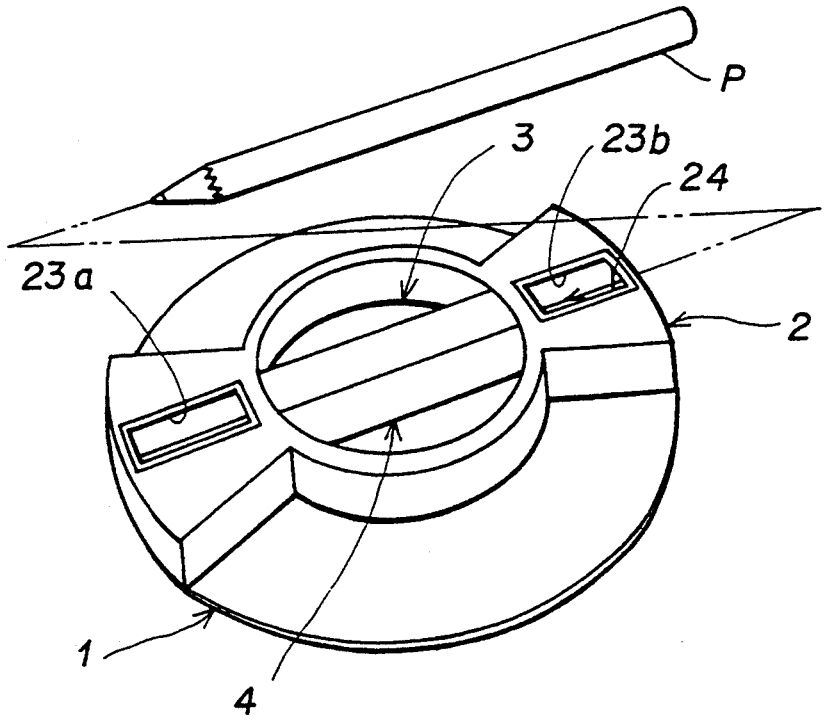
FIG. 12 is a schematic perspective view of the trick article according to the present invention and which is ready for use with a colored pencil which is to be inserted into it.
Figure 13:
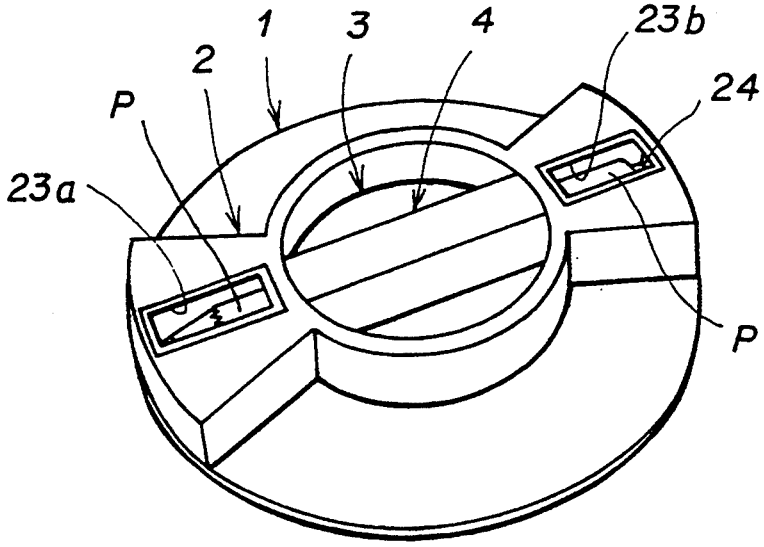
FIG. 13 is a schematic perspective view of the trick article in which the colored pencil is inserted (first position)
Figure 16:
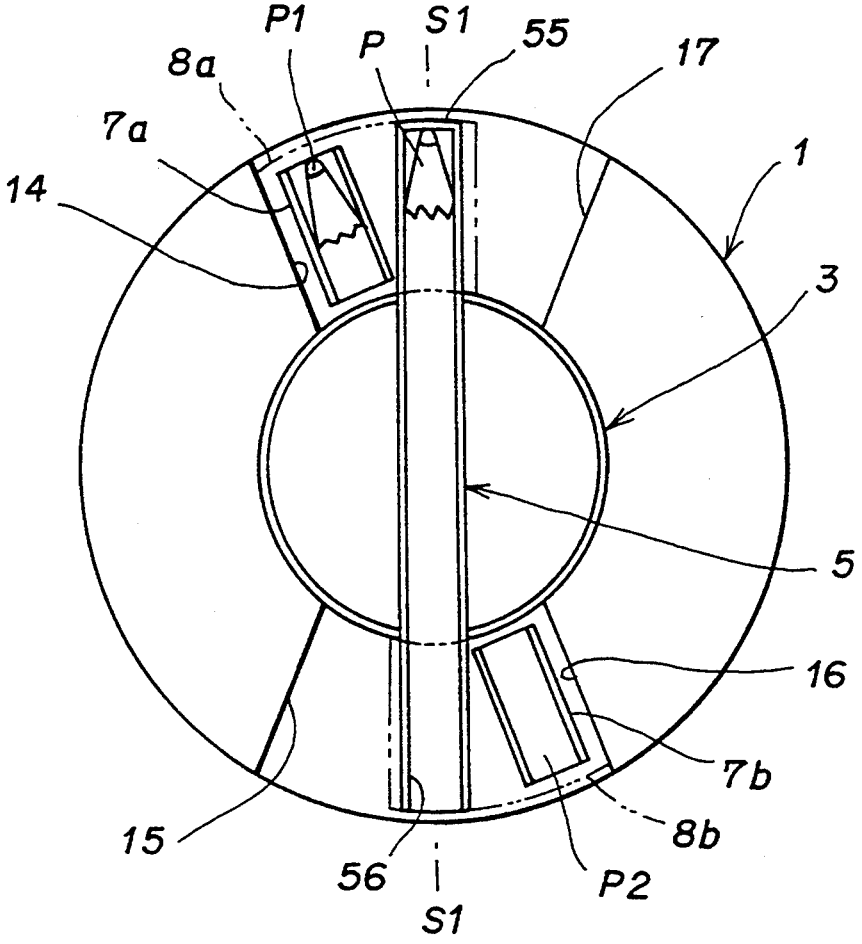
FIG. 16 is an explanatory drawing revealing the trick at the first position shown in FIG. 13.
Figure 17:
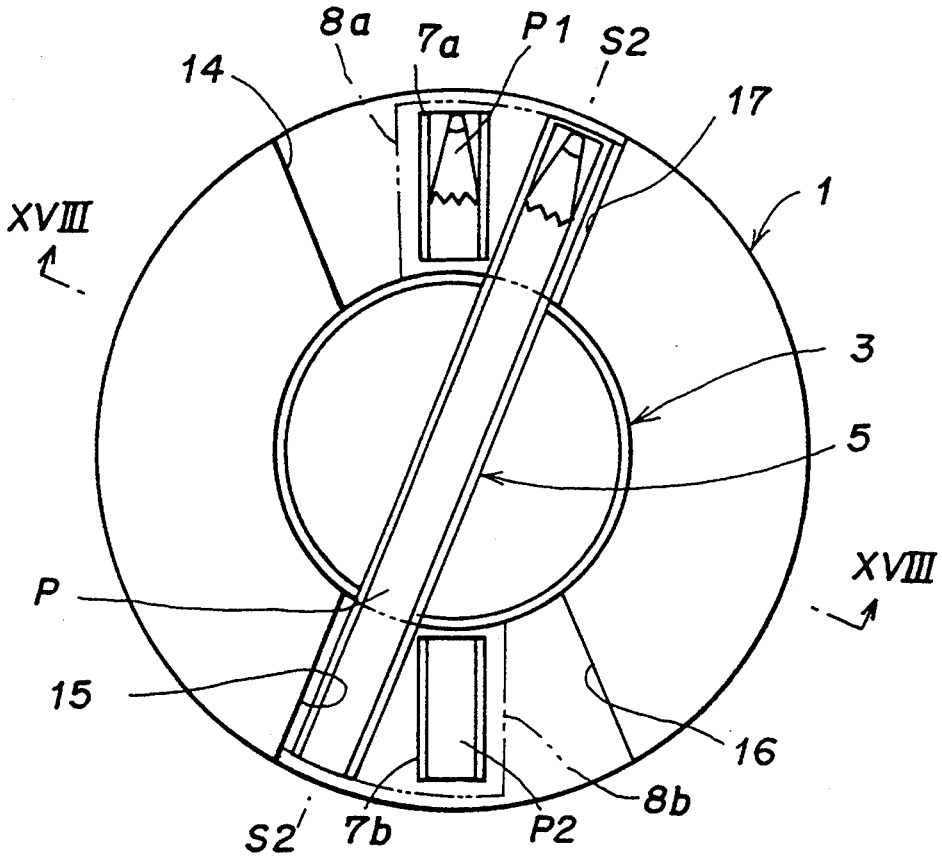
FIG. 17 is an explanatory drawing revealing the trick at the second position shown in FIG. 14.
Figure 18:
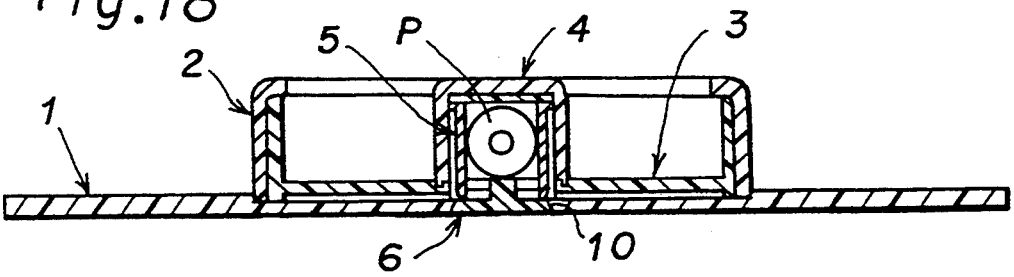
FIG. 18 is a sectional view taken along the line XVIII—XVIII in FIG. 17.
Figure 19:
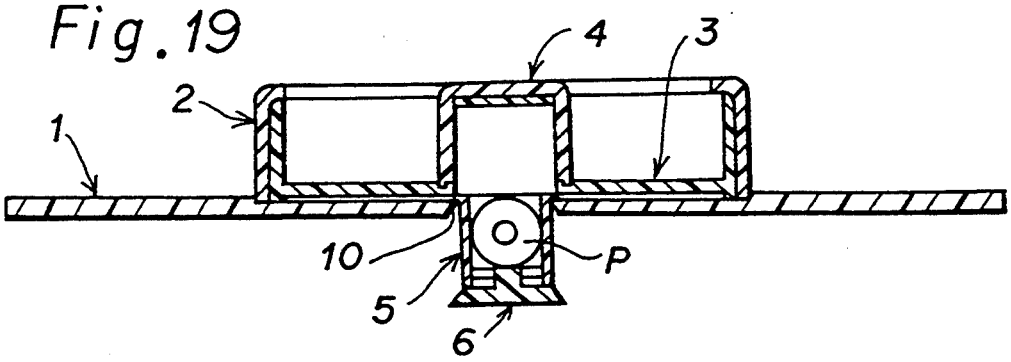
FIG. 19 is a sectional view of the trick article, showing that the rotary member is uncoupled from the auxiliary rotary members in the state shown in FIG. 18.
Figure 20:
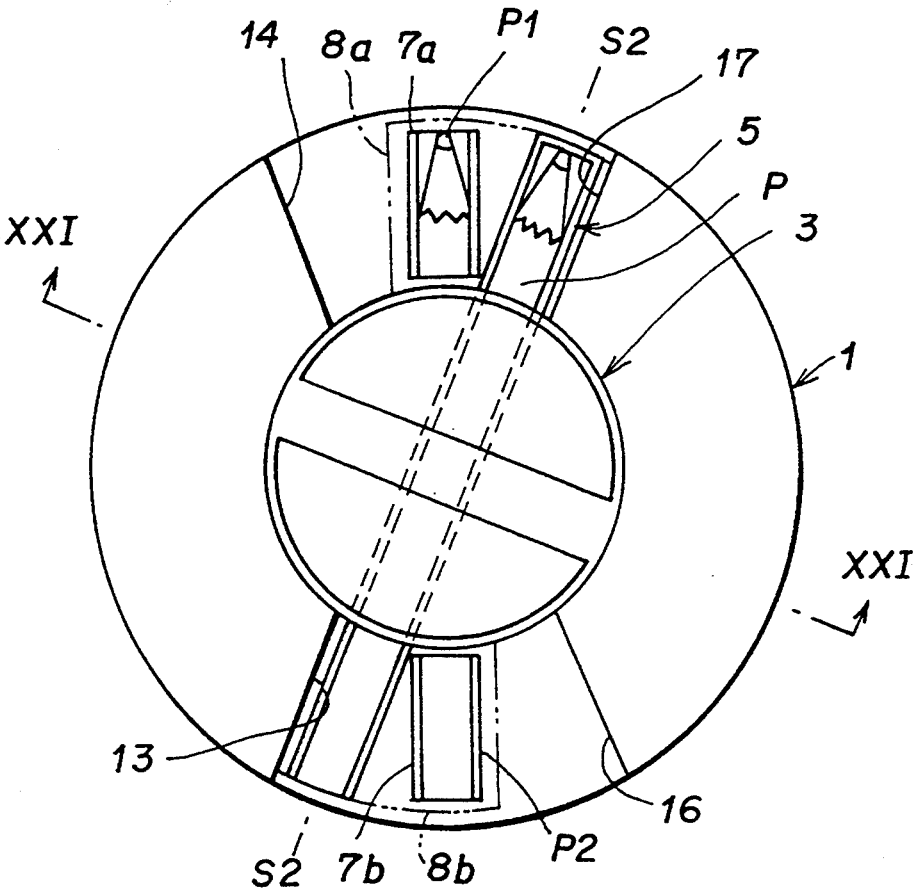
FIG. 20 is an explanatory drawing revealing the trick in the state shown in FIG. 15.
Figure 21:
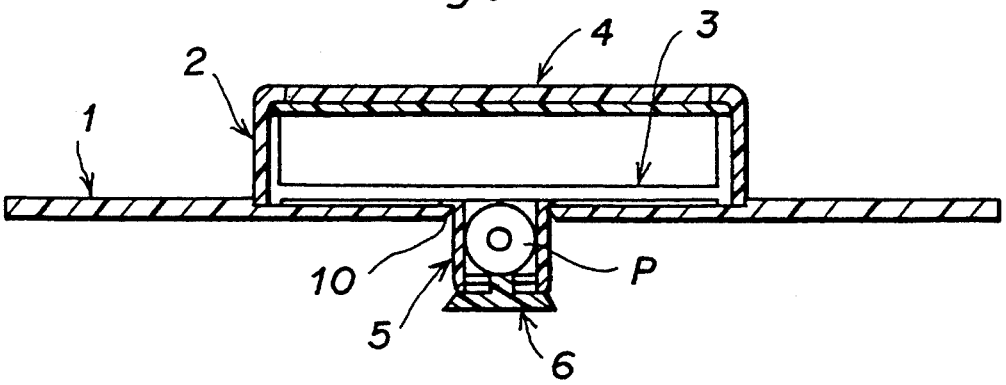
FIG. 21 is a sectional view taken along the line XXI—XXI in FIG. 20.

How to play the trick article according to the present invention will be described herebelow in the playing sequence. First, the user places the article on a table with the rear side of base member I down. Thereafter, he takes a colored pencil P and shows it to the audience. He also has the audience make sure that the two windows **23*a* and 23*b* of the housing member 2 and the cover member or pencil position indicator 4 of the rotary member 3 are in line with each other, as shown in FIG. 12. Thereafter, he inserts the pencil P horizontally into the insertion hole 24. The pencil P is passed through the sub channel 84*b* of the auxiliary rotary member 8*b*, main channel 36 of the rotary member 3 and the sub channel 84*a* of the auxiliary rotary member 8*a* in this order and received into the pencil receiving member 5. At this time, the sharpened and rear end portions of the pencil P are visible from outside through the window 23*a* of the sectorial portion 21*a* and the window 23*b* of the sectorial portion 21*b*, respectively, as shown in FIG. 13. The colored pencil P thus inserted with the rotary member 3 in the first position S1 is shown in FIGS. 16 and 17. On the other hand, the deceptive colored pencils P1 and P2, enclosed by the opaque covers 7*a* and 7*b*, in the second portions 82*a* and 82*b*, respectively, of the auxiliary rotary members 8*a* and 8*b*, respectively, are not visible from outside because they are hidden under the housing member 2. Thus, the audience cannot know that the deceptive colored pencils P1 and P2 but they will have no doubt that the sharpened and rear end portions of the colored pencil P passed through a simple central passage of a disk are received in the two sectorial portions 21*a* and 21*b*, respectively, provided along the opposite circumferential edges, respectively, of the disk and the body portion of the colored pencil P stays in the central passage. The central passage of the disk, giving the audience an impression that the colored pencil P is straightly passed through it, is actually the cover member 4 which covers the bridge member 33 of the rotary member 3. The cover member 4** also serves as an indicator or marker to give the audience an impression that the body portion of the colored pencil P always stays therein.

Figure 14:
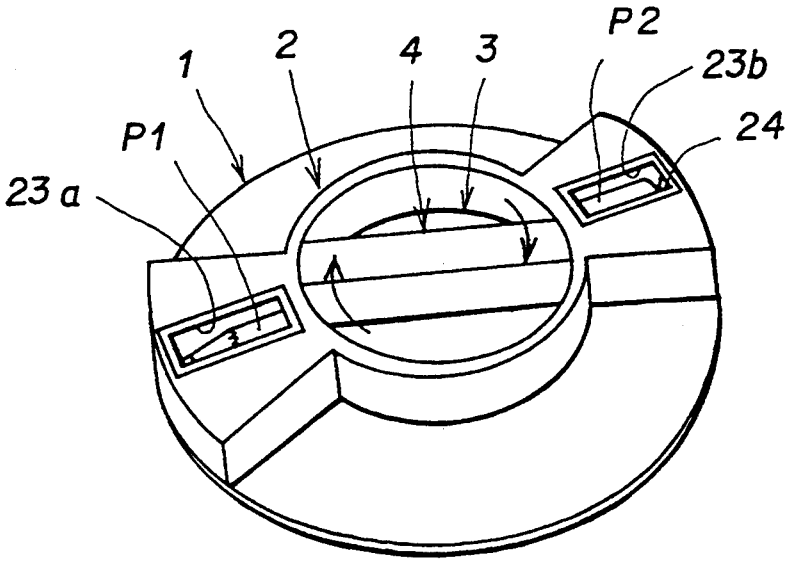
FIG. 14 is a schematic perspective view of the trick article of which the rotary member has been rotated through a predetermined angle in relation to the base member from the first position (second position)
Figure 15:
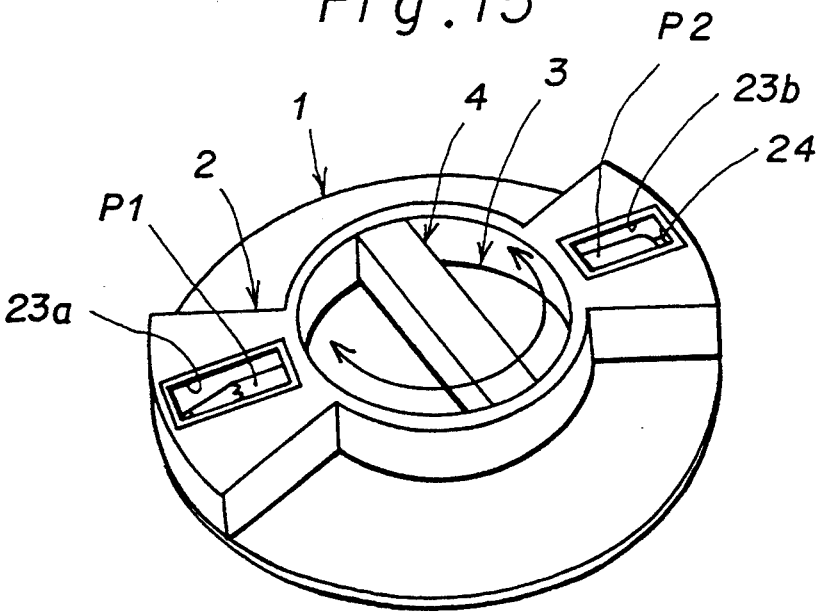
FIG. 15 is a schematic perspective view of the trick article of which the rotary member has been rotated independently of the two auxiliary rotary members.

Next, the user holds the cover member 4 as manipulating lever with his fingers or the like and quickly rotates the rotary member 3 from the first position S1 to the second position S2 (in the direction of arrow in FIG. 14). Then, the sharpened and rear end portions of the colored pencil P, which have so far been visible from outside through the window **23*a* of the sectorial portion 21*a* and the window 23*b* of the sectorial portion 21*b*, respectively, will not be visible from outside as actually hidden under the housing member 2 and simultaneously the deceptive sharpened end portion P1 and rear end portion P2 will appear in the window 23*a* of the sectorial portion 21*a* and the window 23*b* of the sectorial portion 21*b*, respectively. Thus, the colored pencil P will appear to the audience as if it were cut at the boundaries between the cover member 4 and two sectorial portions 21*a* and 21*b*** into three pieces, namely, a sharpened end portion, body portion and rear end portion.

At this time, the rotary member 3 and auxiliary rotary members **8*a* and 8*b* are rotated clockwise on the base member I while being coupled to each other by means of the pencil receiving member 5. The side faces of the first portions 81*a* and 81*b* of the auxiliary rotary members 8*a* and 8*b*, respectively, abut the steps 15 and 17, respectively, of the base member 1, and the second portions 82*a* and 82*b* in which the deceptive sharpened or front end portion P1 and rear end portion P2 are put come to positions corresponding to the windows 23***a* and 23*b*, respectively, of the housing member 2. Also the pencil receiving member 5 comes onto the closing member 6 fitted in the opening 10 of the base member 1 and the positioning convexities 61 on the closing member 6 are engaged in the positioning concavities 54, respectively, in the bottom plate of the pencil receiving member 50.

When the rotary member 3 is in the second position S2, the pencil receiving member 5 comes to just above the opening 10 in the base member 1, as mentioned above. The user raises the whole trick article from the table with the rotary member 3 thus placed in the second position S2. Then, the pencil receiving member 5 in which the colored pencil P is put will fall down into the opening 10 due to its own weight while being kept coupled to the closing member 6 and thus protrude to the rear side of the base member 1. At this time, since the engagement projections 52 of the pencil receiving member 5 engage on the circumferential edges of the opening 10, so the pencil receiving member 5 is prevented from being disengaged from and falling off the base member 1. In this condition, the rotary member 3 is freely rotatable because the pencil receiving member 5 is uncoupled from the auxiliary rotary members 8*a* and 8*b*. While playing the trick article, the user has to carefully handle it so that the audience will not become aware of the projection of the pencil receiving member 5 to the rear side of the base member 1. For example, the user has to hold the entire trick article with the five fingers and incline it to such an extent that the rear side of the base member I will not be viewable from the audience.

Further, the user holds the cover member 4 with the fingers or the like and rotates the rotary member 3 freely clockwise and counterclockwise, for thereby permitting to give the audience a strong illusion that the colored pencil P is cut at the boundaries between the cover member 4 and two sectorial portions 21*a* and 21*b* of the housing member 2 into three pieces, namely, a sharpened end portion, body portion and rear end portion, respectively.

Thereafter, the user rotates the rotary member 3 to the second position S2 as shown in FIG. 14 to have the main channel 36 of the rotary member 3 coincides with the opening 10 of the base member 1. In this condition, the side faces of the first portions 81*a* and 81*b* of the auxiliary rotary members 8*a* and 8*b*, respectively, remain abutting the steps 15 and 17, respectively, of the base member 1 while the second portions 82*a* and 82*b* in which the deceptive colored pencils P1 and P2 are put still correspond to the windows 23*a* and 23*b*, respectively, of the housing member 2. Namely, the main channel 36 of the rotary member 3 is generally in line with the sub channels 84*a* and 84*b* of the auxiliary rotary members 8*a* and 8*b*, respectively. Then, the user lightly pushes up the closing member 6 and fits it into the opening 10 of the base member 1. The pencil receiving member 3 in which the colored pencil P is put will be fitted into the main channel 36 of the rotary member 3 and sub channels 84*a* and 84*b* of the auxiliary rotary members 8*a* and 8*b*, respectively.

Next, the user quickly rotates the rotary member 3 counterclockwise from the second position S2 to the first position S1 as shown in FIG. 13. The deceptive colored pencils P1 and P2 having so far visible from outside through the windows 23*a* and 23*b* of the housing member 2 will be hidden under the housing member 2 and the sharpened and rear end portions of the colored pencil P will appear in the windows 23*a* and 23*b*, respectively. Then the user inclines the entire trick article with the insertion hole 24 of the housing member 2 directed downward. The colored pencil P having appeared as if it were cut into three pieces will come out of the trick article.

As having been described in the foregoing, the trick article according to the present invention permits an easy trick simply by inserting a colored pencil P horizontally into the insertion hole 24 of the housing member 2 and rotating the rotary member 3 from the first position S1 to the second position S2 or vice versa.

More particularly, in this embodiment, the sub channels 84*a* and 84*b* in which the sharpened and rear end portions of the colored pencil P are put are formed in the first portions 81*a* and 81*b*, respectively, of the transparent auxiliary rotary members 8*a* and 8*b*, respectively, the deceptive colored pencils P1 and P2 are put in the second portions 82*a* and 82*b*, respectively, of the transparent auxiliary rotary members 8*a* and 8*b*, respectively, and the deceptive colored pencils P1 and P2 are received by the covers 7*a* and 7*b*, respectively, made of a same material as that of the pencil receiving member 5. Therefore, it is possible to well camouflage the existence of the deceptive pencils P1 and P2, which will further enhance the tricking effect of the trick article.

Note that the colored pencil P used as stick-like thing in the above-mentioned embodiment may be a cigarette or the like.

Having described the present invention as related to the embodiment shown in the accompanying drawings, it is our intention that the present invention be not limited by any of the details of description, unless otherwise specified, by rather be constructed broadly within its spirit and scope as set out in the accompanying claims.

What is claimed is:

1. A trick article giving an illusion of cutting of a stick-like thing such as a cigarette or pencil and restoring the cut stick-like thing to its initial state, comprising:

a base member;

an opaque housing member fixed to the base member and having an insertion hole through which the stick-like thing is inserted;

an opaque rotary member encased in the housing member, disposed rotatably on the base member within a predetermined range of angle between a first and second positions, and having diametrically provided as facing the surface of the base member a main channel which receives a portion of the stick-like thing;

transparent auxiliary rotary members encased in the housing member so as to be rotatable on the base member as interlocked with the rotary member, having radially provided as facing the surface of the base member sub channels which receive the rest of the stick-like thing inserted from the insertion hole, and having fixed therein, as radially directed therein adjacently to the sub channels, deceptive stick-like things identical at least in the appearances to the rest of the stick-like thing;

an indicator provided atop the rotary member correspondingly to the main channel and which indicates the position of the stick-like thing;

a window formed nearly in the middle of the top of the housing member so that the indicator of the rotary member is exposed; and other windows formed in the top of the housing members nearly in line with the insertion hole;

the sub channels of the auxiliary rotary members being generally coincident with the other windows, respectively, when the rotary member is in the first position, while the deceptive stick-like things are nearly coincident with the other windows when the rotary member is in the second position.

2. A trick article giving an illusion of cutting of a stick-like thing such as a cigarette or pencil and restoring the cut stick-like thing to its initial state, comprising:

a base member;

an opaque housing member fixed to the base member and having an insertion hole through which the stick-like thing is inserted;

an opaque disk-like rotary member encased in the housing member, disposed rotatably on the base member within a predetermined range of angle between a first and second positions, and having diametrically provided as facing the surface of the base member a main channel having a size corresponding to that of the stick-like thing;

a pair of transparent auxiliary rotary members encased in the housing member and positioned so that the rotary member is between the auxiliary rotary members, disposed rotatably on the base member, having provided as facing the surface of the base member sub channels which house the front and rear end portions of the stick-like thing inserted from the insertion hole, and having fixed therein, as radially directed adjacently to the sub channels, deceptive stick-like things being a front or rear end portion identical in at least the appearance to the front or rear end portion, respectively, of the stick-like thing;

a means of coupling the rotary member and auxiliary rotary members to each other so that their channels are generally in line with each other;

an indicator provided on the top of the rotary member in a position corresponding to the main channel and indicates the position of the stick-like thing;

a window formed nearly in the middle of the top of the housing member so that the indicator of the rotary member is exposed; and other windows formed in the top of the housing members nearly in line with the insertion hole;

the sub channels of the pair of the auxiliary rotary members being generally coincident with the other windows, respectively, when the rotary member is in the first position, while the deceptive stick-like things are nearly coincident with the other windows when the rotary member is in the second position.

3. A trick article as set forth in claim 2, wherein the coupling means consists of a receiving member which is fitted in the main channel of the rotary member and sub channels of the pair of auxiliary rotary members, the coupling means being rotatable on the base member.

4. A trick article as set forth in claim 3, further comprising a means of releasing the coupling of the rotary member with the auxiliary rotary members when the rotary member is in the first position.

* * * * *